United States Patent [19]

Knab

[11] 4,055,173

[45] Oct. 25, 1977

[54] SURGICAL MASKING AND VENTILATING SYSTEM

[76] Inventor: James V. Knab, 2916 Hall St., SE., Grand Rapids, Mich. 49506

[21] Appl. No.: 570,237

[22] Filed: Apr. 21, 1975

[51] Int. Cl.[2] ..... A62B 7/02

[52] U.S. Cl. ..... 128/139; 128/142.5; 2/DIG. 7; 128/142.7

[58] Field of Search ..... 128/139, 142.3–142.7, 128/146.3, 146.4, 146.6, 146.7, 276, 298, 299, 1 R, 1 B; 417/249, 255, 244, 313; 2/171, 171.3, 173, 202, DIG. 7, 14 B, 14 K; 137/566

[56] References Cited

U.S. PATENT DOCUMENTS

| | | | |
|---|---|---|---|
| 2,688,962 | 9/1954 | Summers | 128/142.7 |
| 3,016,541 | 1/1962 | Archbold | 2/3 C |
| 3,625,206 | 12/1971 | Charnley | 128/139 |
| 3,625,207 | 12/1971 | Agnew | 128/139 |
| 3,723,027 | 3/1973 | Montelius | 417/313 |
| 3,747,599 | 7/1973 | Malmin | 128/142.7 |
| 3,866,244 | 2/1975 | Ruck | 2/3 C |
| 3,868,728 | 4/1975 | Krzeninski | 2/DIG. 7 |
| 3,955,570 | 5/1976 | Hutter | 128/142.7 |

FOREIGN PATENT DOCUMENTS

| | | | |
|---|---|---|---|
| 531,189 | 4/1955 | Italy | 417/244 |

*Primary Examiner*—Robert W. Michell
*Assistant Examiner*—Henry J. Recla
*Attorney, Agent, or Firm*—Leydig, Voit, Osann, Mayer & Holt, Ltd.

[57] ABSTRACT

A surgical masking and ventilating system for protecting an operating zone from contaminants emanated by members of a surgical team during an operation. The system includes protective apparel for substantially isolating each member of the surgical team from the environment of the operating zone, a suction tube connecting the apparel of each member to a vacuum manifold, an aspirator adapted to create a vacuum in the manifold and each suction tube connected thereto for drawing away contaminants within the apparel of each member and creating an air flow that maintains the person at a comfortable temperature, and high efficiency filter means for cleaning the air discharged from the aspirator to a contaminant free condition prior to re-entry into the environment of the operating room. The aspirator includes a vacuum motor and blower motor which together more efficiently and quietly maintain a substantial vacuum in the connecting tubes and reliably direct the discharged air through the resistance of the high efficiency filter. The protective apparel is designed so as not to substantially impair movement or vision of the user.

24 Claims, 12 Drawing Figures

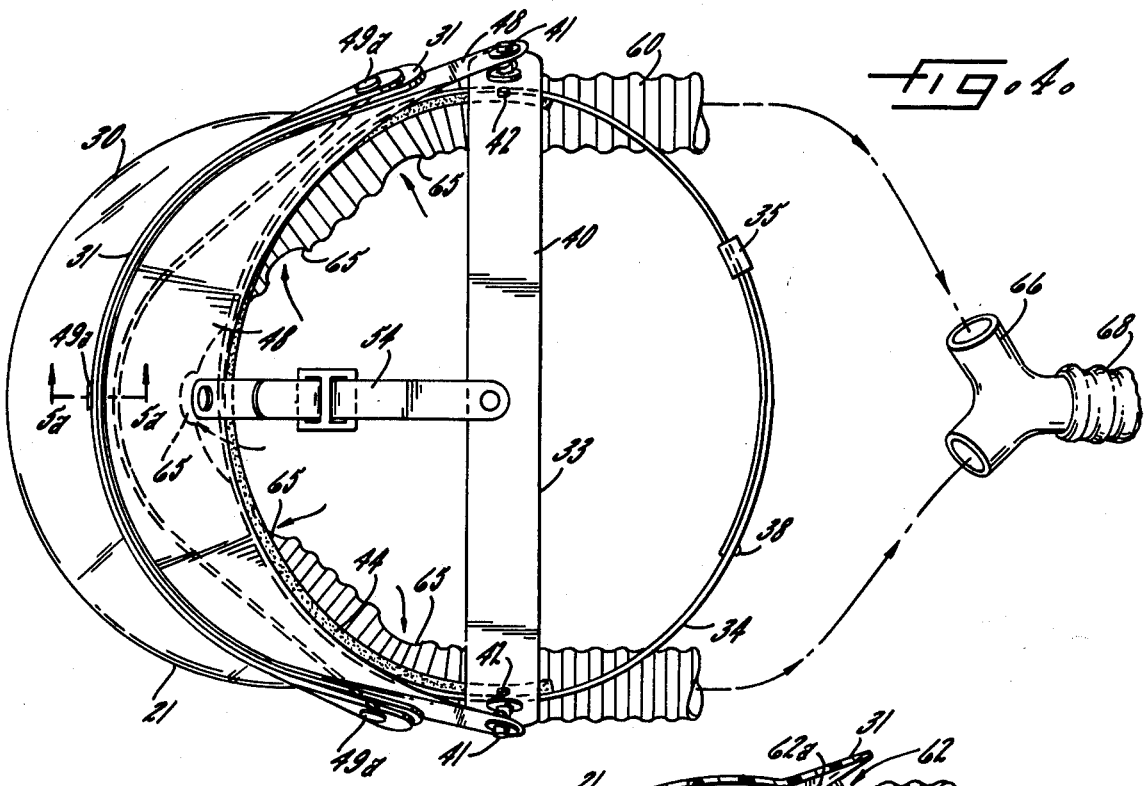
Fig. 4.
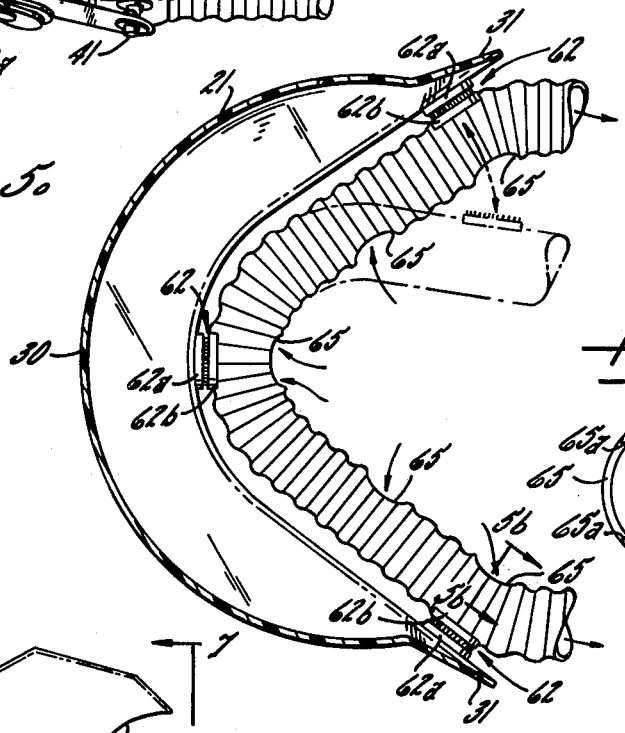
Fig. 5.
Fig. 5a.
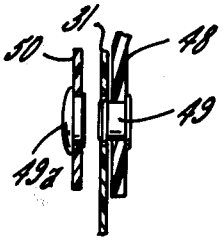
Fig. 5b.
Fig. 6.
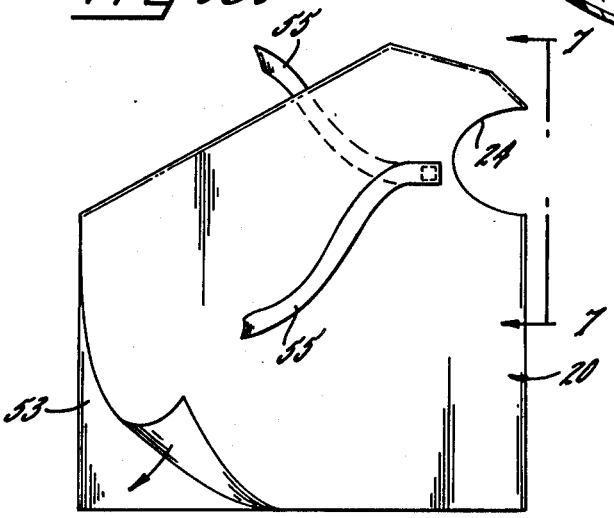
Fig. 7.
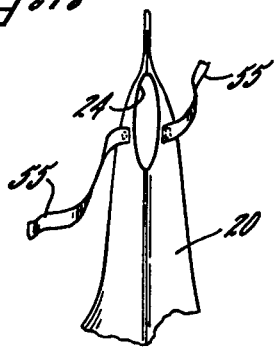

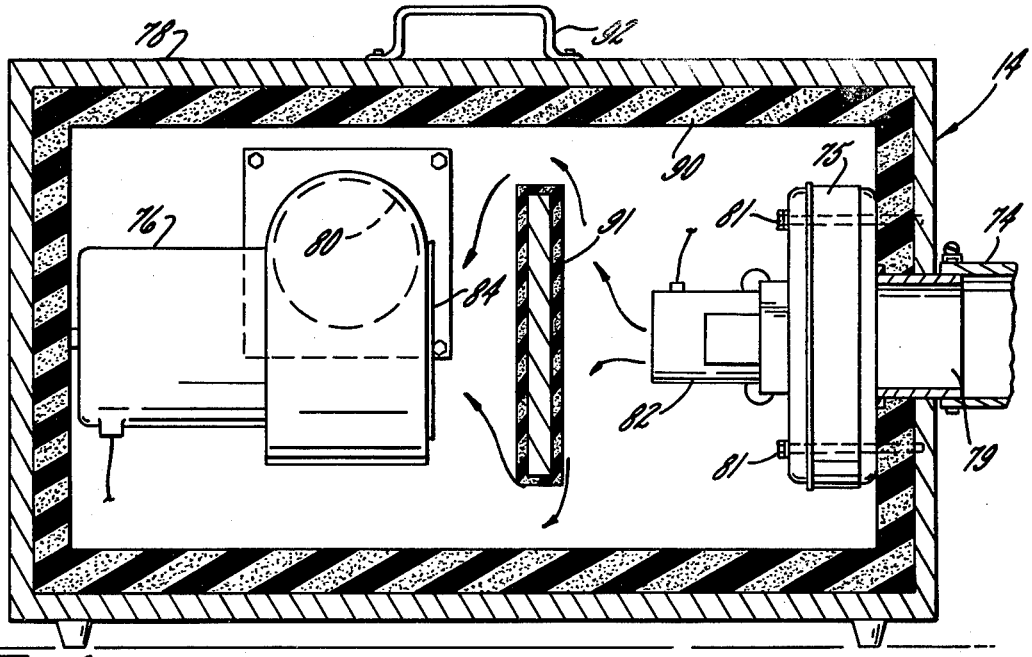
FIG. 8
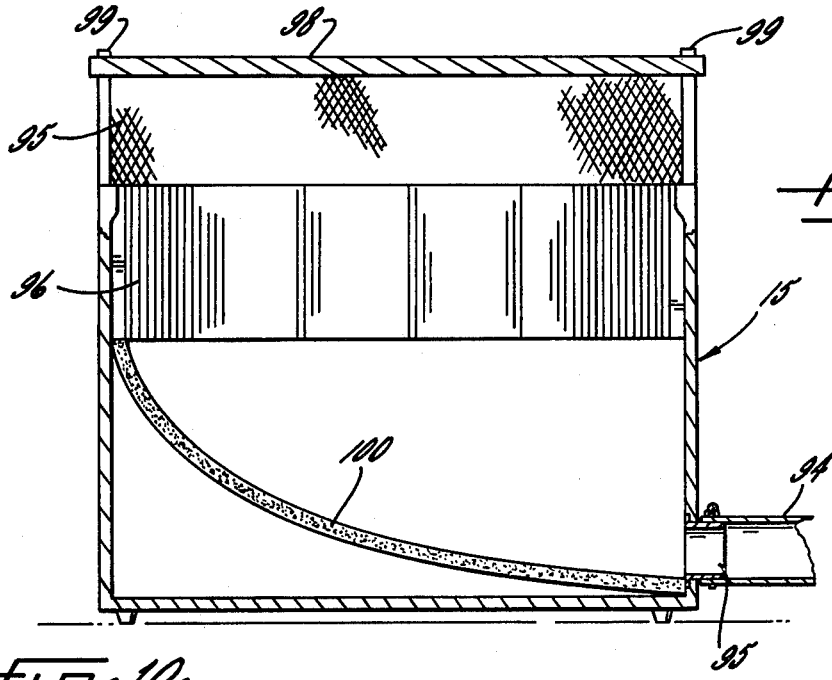
FIG. 9
FIG. 10
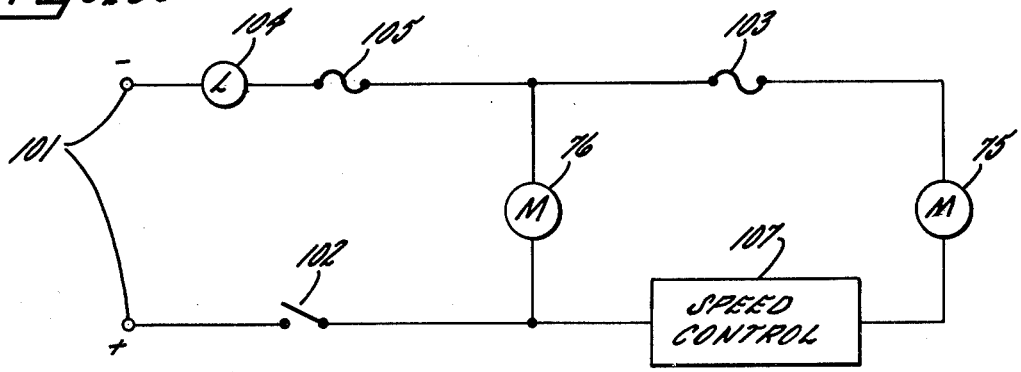

SURGICAL MASKING AND VENTILATING SYSTEM

DESCRIPTION OF THE INVENTION

The present invention relates to surgical masking and ventilating systems or protecting a patient from contaminants emanated by members of the surgical team.

Various masking and ventilating systems have been proposed for drawing away affluent bacteria and other contaminants shed or exhaled by members of the operating team in order to minimize the transfer of such contaminants into the atmosphere of the operating zone. These present systems, however, each have had various drawbacks. Some systems, for example, require complex gowns and accessories that are cumbersome to put on or restrict movement or vision of the wearer. In other systems, in order to effectively draw off the emanated contaminants through a suction hose connected to the gown, a relatively large vacuum blower has been required which creates excessive and annoying noise and impairs communication between members of the operating team.

It is an object of the present invention to provide a surgical masking and ventilating system that is adapted to more efficiently and effectively remove contaminants emitted from members of the operating team.

Another object is to provide a masking and ventilating system as characterized above which operates quietly so as not to interfere with communications among the surgical team.

A further object is to provide a surgical masking and ventilating system of the above kind which may be conveniently used by members of the operating team without substantially restricting their movement or vision.

Still another object is to provide such a masking and ventilating system that is selectively adjustable to permit desired ventilation and cooling of the user.

Yet another object is to provide a system of the above type which includes a transparent visor or mask that is easily removable for cleaning and replacement.

Other objects and advantages of the invention will become apparent as the following description proceeds, taken in conjunction with the accompanying drawings, in which:

FIG. 4 is a top view of the visor shown in FIG. 3;

FIG. 5 is a section taken in the plane of line 5—5 in FIG. 3;

Figure 1:
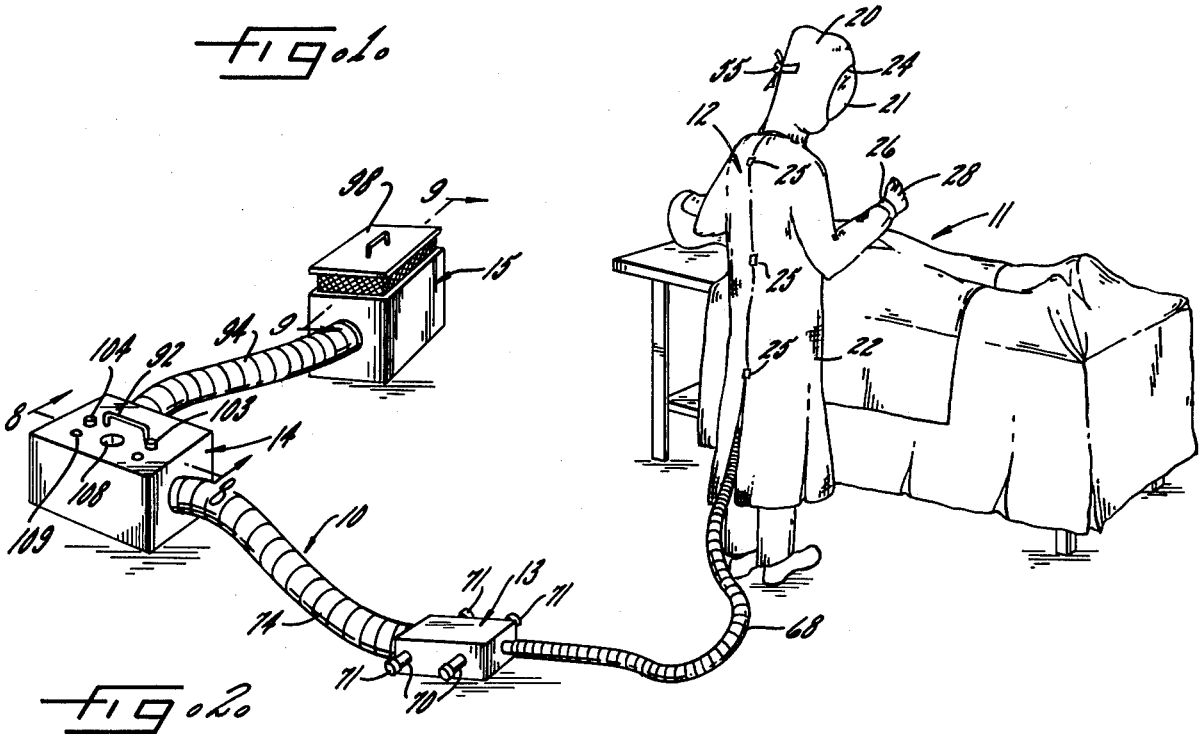
FIG. 1 is a perspective of an illustrative masking and ventilating system according to the present invention being used by a member of a surgical team at an operating table.
Figure 2:
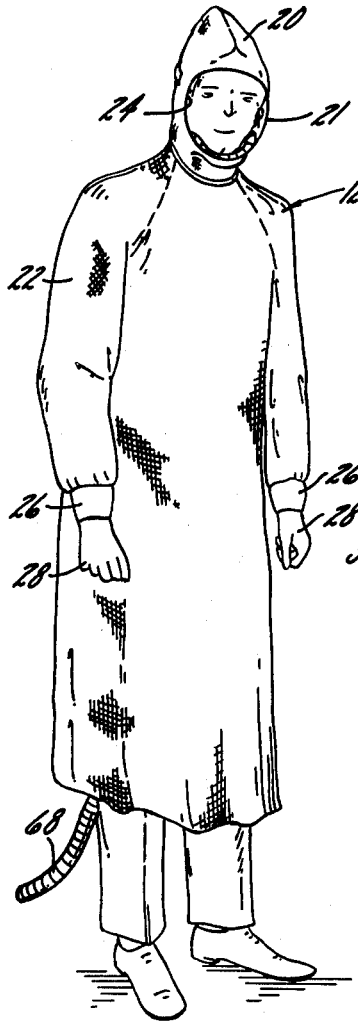
FIG. 2 is a front perspective view of a person wearing the surgical gown and visor utilized in the system shown in FIG. 1.

FIG. 5*a* is an enlarged section taken in the plane of line 5*a*—5*a* in FIG. 4;

FIG. 5*b* is an enlarged fragmentary section taken in the plane of line 5*b*—5*b* in FIG. 5;

FIG. 6 is a side view of the hood used in the illustrated system, shown in a folded condition;

FIG. 7 is a reduced scale perspective of the hood shown in FIG. 6 when in a partially opened condition;

FIG. 8 is an enlarged section of the aspirator used in the illustrated system taken in the plane of line 8—8 in FIG. 1;

FIG. 9 is an enlarged section of the filter box used in the illustrated system taken in the plane of line 9—9 in FIG. 1; and FIG. 10 is a diagrammatic illustration of the electrical control for the aspirator.

While the invention is susceptible of various modifications and alternative constructions, a certain illustrative embodiment thereof has been shown in the drawings and will be described below in detail. It should be understood, however, that there is no intention to limit the invention to the specific form disclosed, but, on the contrary, the intention is to cover all modifications, alternative constructions, and equivalents falling within the spirit and scope of the invention.

Referring more particularly to FIG. 1 of the drawings, there is shown a masking and ventilating system 10 embodying the present invention, which for illustration purposes is shown being used by only one member of a surgical team at an operating zone 11. The system comprises basically protective apparel 12 for each member of the operating team, a vacuum manifold 13 to which the protective apparel of each member is connected, a power aspirator 14 for generating a vacuum in the manifold and drawing away air and contaminants from within the protective apparel of each member, and a filter box 15 through which the air removed from the surgical team is discharged for cleaning to a substantially contaminant free condition prior to re-entry into the environment of the operating room.

The protective apparel 12 for each member of the surgical team includes a hood 20, a visor 21, and a gown 22 positioned over the hood 20, which together effectively isolate the person, at least to below knee level, from the environment of the operating zone 11. The hood 20 has a front aperture 24 for positioning about the visor and preferably extends to at least shoulder level so that the gown 22 when positioned over the hood creates an overlap that effectively prevents the escape of air from within the gown. The gown 22 is of the rear opening type that can be conveniently closed and secured by a plurality of adhesive strips 25 spaced along the length of one side of the opening. The gown 22 preferably is made of a material impermeable to bacteria, such as a plastic, and has an open bottom end slightly above the floor. Each sleeve of the gown 22 is provided with an elastic cuff 26 that firmly engages the wrist portion of plastic gloves 28 commonly worn by surgeons.

Figure 3:
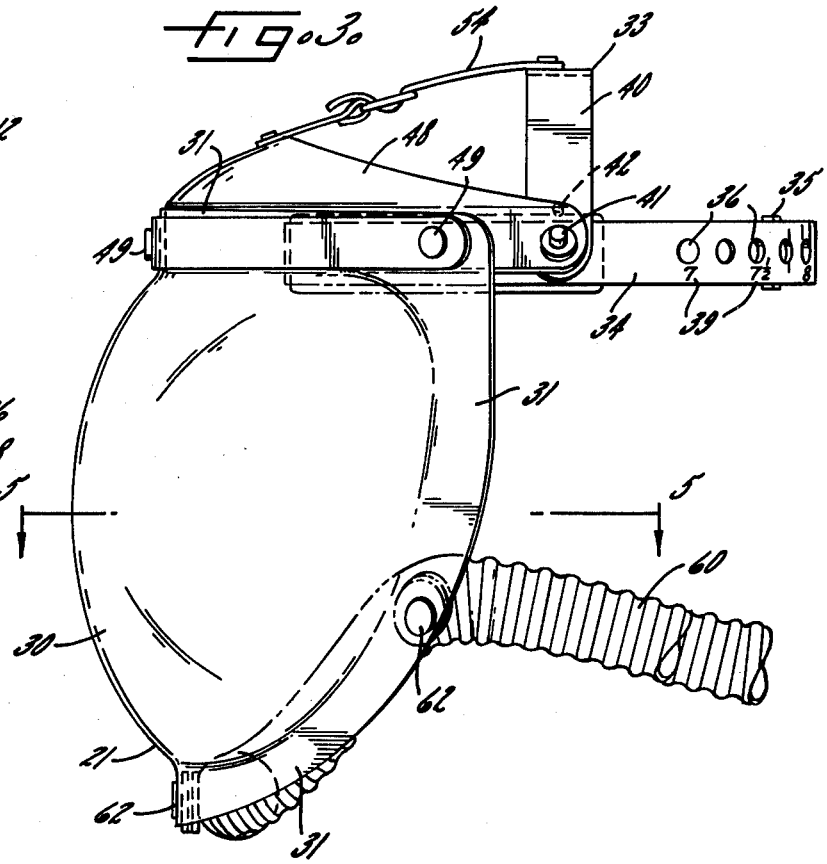
FIG. 3 is an enlarged side elevation of the visor used in the system of FIG. 1 together with its supporting headpiece and associated suction tube.

In accordance with one aspect of the invention, the visor has a spherical shaped front portion and the hood has a rear slit opening which may be tied together to secure the hood in place and at the same time maintain the periphery of the front hood aperture snugly against the visor without auxiliary fastening means. The visor 21, which is best shown in FIGS. 3–5, is made of a clear, lightweight plastic and has a spherical shaped front portion 30 with a flat generally outwardly extending flange 31 about its periphery. The visor 21 is releasably mountable on an adjustable headpiece 33 that includes a horizontal band 34, the free ends of which are connected together to form a circular configuration for positioning about the head. One end of the band 34 has a connecting member 35 formed with a slot through which the other end is positioned. To permit selective adjustment of the band, a plurality of apertures 36 are formed in the band at spaced intervals from the connecting member 35 and the opposite end of the band has a fastening button 38 that may be snapped through the appropriate aperture 36. The band 34 may be made of flexible plastic material with numerals 39 embossed adjacent the respective aperture 36 corresponding to the head size when the button is secured in such aperture.

A top band 40, again preferably made of a flexible plastic, extends from one side of the horizontal band 40 to the other side in an arced fashion for positioning over the top of the head. A pin 41 extends through each side of the horizontal band 34 and the respective end of the top band 40, and in the present instance, a secondary snap or pin 42 is provided on each side to prevent relative pivotable movement between the bands 34 and 40. The forward portion of the horizontal band 34 has a sponge pad 44 along its inside surface for more comfortable positioning of the headpiece on the forehead of the wearer.

For supporting the visor 21 on the headpiece 33, an arcuate shaped support member 48 also is mounted on the pins 41. The visor support member 48 preferably is made of a relatively hard, inflexible plastic that is shaped to extend a distance out from the head of the wearer. In order to releasably attach the visor 21 to the support member 48, the support member 48 has a plurality of spaced snap members 49 that are positionable through apertures in the upper portion of the visor flange 31. An outer strap 50 is provided with a plurality of correspondingly spaced snap heads 49*a* that releasably engage the support snaps 49 to hold the visor in place. To permit selective positioning of the visor 21, the visor support member 48 is pivotable on the pins 41 relative to the horizontal and top bands 34, 40 and may be secured at a desired position by an adjustable strap 54 connected between the top band 40 and the support member 48. It will be seen that by reason of the spherical configuration of the visor 21 and its support in spaced relation to the head of the wearer, it facilitates air circulation, allows room for eyeglasses, and permits a wide range of vision to the user.

When the hood 20 and visor 21 are properly in position, they form a complete enclosure of the head and shoulders of the wearer. As shown in FIGS. 6 and 7, the front hood aperture 24 is circular in shape for receiving the protruding spherical visor portion 30, and the hood 20 has a slit 53 in the rear side thereof that permits easy positioning of the hood over the visor. To secure the hood 20 so that the periphery of the aperture 24 fits snugly against the visor 21 about the periphery of the spherical portion 30, a pair of tie strings 55 are provided on each side of the hood directly to the rear of the aperture 24 and may be tied together at the back of the head. The hood 20 preferably is of a fire retardant plastic and may be folded in individual packages in a presterilized condition.

For drawing away epithelial scales, breath droplets and other affluent contaminants emanated from the body or clothing of the user of the protective apparel, a suction tube 60 is secured to the inside of the visor 21 at the mouth area and coupled to the vacuum manifold 13. The suction tube 60 preferably is a corrugated crush resistant plastic tubing and extends in a loop adjacent the inside of the lower portion of the visor flange 31. To releasably secure the tube 60 to the visor, a plurality of snaps 62 are provided. The snaps 62 may be of a type sold under the trade name Velcro, having one member 62*a* riveted or otherwise secured to the inside of the mask flange 31 and a second member 62*b* secured to an outside surface of the hose 60. Such snap members each have an engageable surface in the form of small protruding members of a known type which positively but releasably engage each other when the snap members are forced into close contact.

To permit the communication of the vacuum in the tube 60 to within the protective apparel 12, a plurality of spaced apertures 65 are formed in the tube 60 adjacent the mouth area. The periphery of each aperture 65 in the tube 60 preferably is formed with a rounded edge 65*a* as shown in FIG. 5*b.* Such an edge may be formed by inserting a heated metal rod into each aperture after it has been punched or otherwise initially formed in the tube. Insertion of such a heated rod causes the plastic material of the tube to melt around the periphery of the aperture and assume the rounded condition. It has been found that the formation of the suction tube apertures with such rounded edges substantially eliminates hissing and nozzling noises commonly generated by the passage of air through sharp edged holes.

The opposite ends of the looped suction tube 80 extend over the shoulders of the user and part way down the back where they are connected to adjacent legs of a Y junction tube 66, as shown in FIG. 4, and a connecting tube 68 of similar size and corrugation is coupled between a third leg of the junction tube 66 and the vacuum manifold 13. The manifold 13 in the present instance is a hollow, rectangular box with a plurality of sleeves or nozzles 70, each of which serve as an outlet for the connecting tube 68 of one of the members of the operating team. The tubes 68 each may be easily slipped onto a manifold nozzle with a friction fit, and to prevent unnecessary dissipation of the vacuum within the system when some nozzles are not in use a removable closure cap 71 is provided for the nozzle 70. The manifold 13, which preferably has a plastic coated exterior to facilitate its cleaning, is connected to the aspirator by a main suction conduit 74. It has been found that the suction and connecting tubes 60 and 68 may be of relatively small diameter, such as ¾ inch, while the main suction conduit 74 should be of a sufficiently large diameter, such as on the order of 2½ inches, to facilitate the total air flow for the system. While for illustrative purposes the vacuum manifold 13 is shown at a position remote from the operating zone 11, in practice it has been found desirable to place the manifold 13 beneath or in close vicinity to the operating table so that each member of the operating team, with their respective suction tube 68 connected to the manifold, is permitted a wide latitude of movement about the operating table.

In keeping with the invention, the aspirator is adapted to more efficiently and quietly create a substantial vacuum within each suction tube for reliably drawing away contaminants from within the protective apparel and creating an air flow up through the apparel that maintains the user at a comfortable temperature. To this end the aspirator 14 has a dual fan arrangement comprising a vacuum motor 75 of a type having a relatively high vacuum generating capability and relatively low air directing capacity and a blower motor 76 located downstream of the vacuum motor and having relatively high air directing capacity and relatively low vacuum generating capabilities. As shown in FIG. 8, the aspirator has a housing 78, again preferably made of a plastic coated material, with an inlet 79 and an outlet 80. The vacuum motor 75 is secured to an end wall of the aspirator housing 78 by bolts 81 and has a centrally located air inlet coupled coaxially with the aspirator inlet 79 and an outlet 82 which discharges into the interior of the aspirator. The blower motor 76 is mounted on a side wall of the aspirator housing and has an inlet 84 within the aspirator and an outlet coupled to the aspirator outlet 80.

The vacuum motor 75, while being of a design capable of drawing a substantial vacuum in the upstream suction tubes 60, 68, need not be adapted for directing or pushing air through any sizable downstream resistance. For example, the vacuum motor 75 may be of the through-flow type sold by Ametek/Lamb Electric under Model No. 115717. Such a vacuum motor with a 2 inch inlet orifice is adapted to drawn an air flow of 105 cubic feet/minute at a vacuum of 4.1 inches of water. The blower motor 76 also may be of any inexpensive design, although in this case of a type that at zero back pressure can direct a relatively high downstream air flow through a significant resistance. The blower motor need not be capable of drawing a significant upstream vacuum. For example, the blower motor 76 may be of the shaded pole type sold by Dayton Electric Manufacturing Company under Model No. 4C005. Such a blower when operated with no back pressure can direct a downstream air flow of 148 cubic feet/minute with a zero back pressure.

The aspirator 14 with such a vacuum motor and blower motor combination has been found to operate with improved efficiency, reliability, and quietness. The vacuum motor 75 creates a significant vacuum in the suction tubes 60, 68 and prevents a negative back pressure from being created at the blower motor 76 so as to enable the blower to discharge air at its maximum efficiency. In addition, the high rate of discharge from the aspirator by reason of such a blower creates a constant, cooling air flow through the vacuum motor which optimizes its performance. Thus, the illustrated aspirator has been found to be capable of producing an output of about 150 cubic feet/minute, which is more than adequate for serving five members of an operating team from a single manifold 13. While it will be understood that vacuum and blower motors of different sizes can be used, for optimum economy and performance the vacuum motor 75 preferably should be capable of drawing at least 75 cubic feet/minute with a vacuum of 4 inches of water and the blower motor 76 should be capable of generating an output air flow of at least 100 cubic feet/minute at a static resistance of ½ inch of water.

In order to minimize the noise of the aspirator, the inside walls of the aspirator housing 78 are lined with a layer 90 of cellular foam and a foam covered baffle plate 91 is secured to the side wall of the housing and extends in cantilever fashion between the vacuum motor 75 and blower motor 76. The air discharging from the vacuum motor 75 strikes the baffle plate 91 and the foam covered side walls in its travel to the blower motor inlet, and thus has been found to have a significant dampening effect on the operating sounds. One side of the aspirator housing 78 preferably is removable to permit service of the blower and vacuum motors 75 and 76, and a handle 92 is secured to the top of the housing to facilitate its positioning at a desired location, which generally is remote from the operating zone.

For cleaning the air discharged from the aspirator 14 to a substantially contaminant free condition, the outlet 80 of the aspirator is connected to the filter box 15 by a conduit 94. The filter box 15 has an inlet coupling 95 in the base thereof to which the conduit 94 is secured, and a screen enclosed upper portion 95 serves as the outlet for the filter box. A high efficiency filter 96 is horizontally supported directly below the screen portion 95 so that all air proceeding from the inlet 94 to the outlet 95 passes through the filter. The filter 96 is of a type commonly referred to as HEPA (High Efficiency Particle Air) filter which is commerically available and capable of screening out 99.97 percent of all airborne particles of 0.3 micron and larger in size. The filter box 15 in this case has a top 98 that is removable upon removal of fastening bolts 99 to permit periodic replacement of the filter 96.

To further absorb and dampen the vacuum and blower motor sounds traveling with the moving air, a foam sheet 100 extends in an arcuate fashion from a position immediately below the inlet 94 to a position adjacent the filter 96 so that air entering the filter box also tends to strike this foam sheet. Air directed into the filter box by the blower motor 76, therefore, is further treated acoustically by the film layer 100, is cleaned to a substantially contaminant free condition as it passes through the filter 96, and is then quietly and gently diffused from the filter box outlet screen 95 back into the atmosphere.

In keeping with the invention, the aspirator has a control which when energized automatically starts the blower motor at full speed while permitting the speed of the vacuum motor to be selectively adjusted. As diagrammatically shown in FIG. 7, the blower motor 76 is connected in parallel across a power source 101 and is energized upon closure of the main control switch 102. A signal light 104 and safety fuse 105 are connected in series with the blower motor 76. The vacuum motor 75 similarly is connected in parallel to the power source 101 and has its own safety fuse 103. For varying and controlling the speed of the vacuum motor 76, a variable speed control unit 107 of a known type is provided in series with the vacuum motor. A dial 108 for the speed control 107 is located on the top panel of the aspirator housing 78 for convenient access.

When the switch 102 is closed, such as through depression of a start button 109 also located in the top of the aspirator housing, the blower motor 76 will start at full speed, thereby initiating an air flow through the aspirator which tends to reduce the pressure upstream of the vacuum motor and facilitate its subsequent operation. The vacuum motor speed control 107 may then be selectively adjusted by the dial 108 to provide the desired ventilation for maximum comfort of the surgical team. In addition, as previously discussed, the operation of the vacuum motor 75 will tend to eliminate the back pressure at the blower motor to permit it to operate at maximum efficiency in directing air out of the aspirator and through the resistance of the final filter 96. It will be appreciated that in addition to the improved operating efficiency resulting from the vacuum motor and blower motor combination, such arrangement further enhances the safety of the system since if one of the motors should fail to function during an operation the other would provide sufficient ventilation to enable the operation to be completed without interruption.

In using the system, prior to the customary scrub undertaken by members of the operating team, the visor 21 and headpiece 33 are cleaned with a sterilizing solution and placed upon the head of the user. The scrub may then by completed in the normal fashion. The connecting tube 68 for each member of the operating team should then be connected to a respective nozzle of the vacuum manifold 13 and the unused nozzles covered with a closure cap 71. The vacuum manifold 13 may be placed under the operating table with the connection hoses conveniently arranged as desired. The opposite end of each connecting hose is connected to a respective Y joint for the suction tube 60 which previously has been snapped to the visor 21.

The hood 20, preferably pre-packaged in sterile condition, is then unpacked and positioned over the head and visor with the spherical visor portion 30 protruding through the front hood aperture 24. The tie strings 55 are tied together to secure the hood in place and maintain the periphery of the hood aperture 24 in snug relation to the visor. The gown 22 may then be donned in the usual manner and the rear gown opening secured together in such a manner that enough room is allowed to permit air to flow inside the gown. The aspirator start button 109 may then be actuated to start the blower motor 76 and the vacuum motor dial 108 adjusted for the desired comfort of the surgical team.

During the operation of the system, the vacuum generated in the suction tube 30 by the aspirator 14 is communicated to the interior of the protective apparel through the apertures 45 in the tube 60 and air and contaminants from within the apparel are drawn out through the suction tubes 60 and 68 and directed through the high efficiency filter 96. The resulting air flow from the floor level up through the gown and hood of the protective apparel, which is adjustable through control of the speed of the vacuum motor 75, maintains a comfortable temperature within the apparel during even prolonged surgical operations.

In view of the foregoing, it can be seen that the surgical masking vacuum and ventilating system of the present invention is adapted to more efficiently and effectively remove contaminants emanated by members of the surgical team and to maintain them at a comfortable temperature. The novel vacuum motor and blower motor combination is adapted to create a significant upstream vacuum for removing contaminants and also effectively discharge the air through the resistance of the final filter. Since both the vacuum motor and blower motor may be of a simple inexpensive design and of relatively small size, the system is economical to manufacture and operates quietly so as not to interfere with communications among the surgical team. The system also is readily portable so as to permit its use in any of several operating rooms in a hospital as the need arises. The protective apparel also may be easily donned and does not substantially restrict movement or vision. Moreover, since the visor is removable, it may be retained by each surgeon for his personal use and is replaceable when desired.

I claim as my invention:

1. A surgical masking and ventilating system for protecting an operating zone from contaminants emanated by members of a surgical team comprising protective apparel for substantially isolating each said member from the environment of the operating zone, an aspirator, said aspirator having an enclosed housing with an inlet and an outlet, conduit means connecting said aspirator inlet to the interior of the protective apparel of each said member, a vacuum motor supported within said aspirator housing and having an inlet coupled to said housing inlet and an outlet communicating with the interior of said housing, said vacuum motor being operable to create a vacuum in said conduit means for drawing air and affluent contaminants within the apparel of each said member to said aspirator, a a blower motor supported within said housing and having an inlet communicating with the interior of said housing and an outlet coupled to said housing outlet for directing said air and contaminants from said aspirator, said vacuum motor having a relatively high vacuum generating capacity and a relatively low air directing capacity and said blower motor having a relatively high air directing capacity and relatively low vacuum generating capability, and high efficiency filter means connected to said blower outlet for filtering said air directed from said aspirator to a substantially contaminant free condition.

2. The surgical masking and ventilating system of claim 1 in which said conduit means includes a vacuum manifold, a conduit connecting said aspirator to said manifold, and a suction tube connecting the protective apparel of each said member to said manifold.

3. The surgical masking and ventilating system of claim 2 in which said vacuum manifold has a plurality of nozzles, and the suction tube of each member of the operating team is connected to one of said nozzles.

4. The surgical masking and ventilating system of claim 1 including a baffle plate positioned within said housing between said vacuum motor and blower motor for dampening the operating sounds of said vacuum motor and blower motor.

5. The surgical masking and ventilating system of claim 4 in which said baffle plate has a foam covering.

6. The surgical masking and ventilating system of claim 5 in which the inside surfaces of the aspirator housing are lined with a cellular foam layer for further dampening the operating sounds of said vacuum motor and blower motor.

7. The surgical masking and ventilating system of claim 5 including a filter box having an outlet and an inlet, a second conduit coupling said aspirator outlet to said filter box inlet, and said high efficiency filter means being supported within said filter box between the inlet and outlet thereof.

8. The surgical masking and ventilating system of claim 7 including a foam barrier sheet mounted within said filter box between said filter box inlet and said high efficiency filter so as to be in the path of air entering said filter box through said filter box inlet.

9. The surgical masking and ventilating system of claim 1 in which said vacuum motor is operable to draw an air flow in said conduit means of at least 75 cubic feet/minute at a vacuum of 4 inches of water, and said blower motor is operable to discharge an air flow of at least 100 cubic feet/minute at a static resistance of ½ inch of water.

10. The surgical masking and ventilating system of claim 1 in which said vacuum motor is operable to draw an air flow of about 100 cubic feet/minute at a vacuum of at least 4 inches of water, and said blower is operable to direct air flow of about 150 feet/minute at a zero back pressure.

11. The surgical masking and ventilating system of claim 1 in which said aspirator includes control means which when energized starts said blower motor at a predetermined relatively high speed while permitting the speed of said vacuum motor to be selectively adjusted.

12. A surgical masking and ventilating system for protecting an operating zone from contaminants emanated by members of a surgical team comprising protective apparal for substantially isolating each said member from the environment of the operating zone, said apparel for each member including a transparent visor, said visor having an arcuate front portion and a flat flange about the periphery of said arcuate portion, a headpiece for supporting said visor on the head of a member, said headpiece having an adjustable horizontal band of flexible material, a rigid arcuate shaped visor support having terminal ends thereof secured to said horizontal band at diametrically opposed portions thereof and extending outwardly in spaced relation from said horizontal band and thereby, from the head of the member upon which it is positioned for supporting said visor a distance from the front of said head, means for releasably securing said visor to said visor support, said releasable visor securing means including a plurality of snap members secured on said visor support in spaced relationship to each other, said visor having a plurality of correspondingly spaced apertures positioned along the upper periphery of said flange which receive said support snap members when said visor is positioned on said support, at least one fastening member releasably fastened on said support snaps to retain said visor in place, a hood positioned over said visor and extending at least to shoulder length, a gown positioned over the shoulder portion of said hood and extending at least to knee level, said hood having a front aperture within which said visor arcuate portion is positioned, means for maintaining the periphery of said front aperture firmly against said visor, an aspirator, conduit means connecting said aspirator to said apparel of each member, said conduit means including a suction tube extending in a loop about the mouth of the visor with the opposite ends positioned at the back side of the user and means coupling said suction tube ends to said aspirator, means for releasably fastening the looped portion of said suction tube to said visor, said aspirator being operative to generate a vacuum in said conduit that draws air and contaminants within said apparel into said conduit and away from said operating zone, and means for filtering the air drawn from said apparel a substantially contaminant free condition prior to its discharge into the environment of the operating zone.

13. The surgical masking and ventilating system of claim 12 in which said horizontal band has one end formed with a plurality of longitudinally spaced apertures and the other end formed with a fastening member positionable in a selected one of said band apertures, and indicia adjacent at least some of said band apertures for indicating the head size of said band when said fastening member is positioned in such aperture.

14. The surgical masking and ventilating system of claim 12 in which said visor support is pivotably movable with respect to said horizontal band, and means for securing said visor support at any selected outwardly pivoted position relative to the vertical.

15. The surgical masking and ventilating system of claim 12 in which said tube fastening means secures said tube to a lower inside surface of said visor flange, and said tubing is formed with a plurality of apertures in close relation to the mouth area.

16. The surgical masking and ventilating system of claim 15 in which the peripheral edges of said tubing apertures have a rounded configuration.

17. The surgical masking and ventilating system of claim 12 in which said hood is of a rear opening type, and said means for maintaining the periphery of said hood aperture against said visor is a pair of straps attached to said hood on opposite sides and to the rear of said front hood aperture.

18. A surgical masking and ventilating system for protecting an operating zone from contaminants emanated by members of a surgical team comprising protective apparel for substantially isolating each said member from the environment of the operating zone, said apparel for each member including a transparent visor, means for supporting said visor on the head, a rear opening hood positioned over said visor and extending at least to shoulder length, and a gown positioned over the shoulder portion of said hood and extending at least to knee level, said hood having a front aperture within which said visor is positioned, means for releasably securing together said rear opening hood with the periphery of said front aperture firmly against said visor, an aspirator, said aspirator having an enclosed housing with an inlet and an outlet, conduit means connecting said aspirator inlet to the interior of the protective apparel of each said member, a vacuum motor supported within said aspirator housing and having an inlet coupled to said housing inlet and an outlet communicating with the interior of said housing, said vacuum motor being operable to create a vacuum in said conduit means for drawing air and affluent contaminants within the apparel of each said member to said aspirator, a blower motor supported within said housing and having an inlet communicating with the interior of said housing and an outlet coupled to said housing outlet for directing said air and contaminants from said aspirator, said vacuum motor having a relatively high vacuum generating capacity and a relatively low air directing capacity and said blower motor having a relatively high air directing capacity and relatively low vacuum generating capability, and high efficiency filter means connected to said blower outlet for filtering said air directed from said aspirator to a substantially contaminant free condition.

19. The surgical masking and ventilating system of claim 18 in which said conduit means includes a vacuum manifold having a plurality of outlets, a conduit connecting said aspirator to said manifold, a suction tube connecting the protective apparel of each said member to one of said manifold outlets, a baffle plate positioned within said aspirator housing between said vacuum motor and blower motor, said baffle plate having a foam covering for dampening the operating sounds of said vacuum motor and blower motor adjacent said vacuum fan, and the inside surfaces of the aspirator housing being lined with a cellular foam layer for further dampening the operating sounds of said vacuum motor and blower motor.

20. The surgical masking and ventilating system of claim 18 in which said vacuum motor is operable to draw an air flow in said conduit of at least 75 cubic feet per minute at a vacuum of 4 inches of water, and said blower motor is operable to discharge an air flow of at least 100 cubic feet per minute at a static resistance of ½ inch of water.

21. The surgical masking and ventilating system of claim 18 in which said visor has a spherical front portion and a flat flange about the periphery of said spherical portion, and the periphery of said hood aperture is positionable firmly against said visor flange portion upon securement of said rear opening hood.

22. The surgical masking and ventilating system of claim 18 in which said conduit means includes a suction tube extending in a loop about the mouth of the visor, and means for releasably fastening the looped portion of said tube to a lower inside surface of said visor, a headpiece, and means for releasably securing an upper portion of said visor flange to said headpiece.

23. The surgical masking and ventilating system of claim 22 in which said headpiece includes an adjustable horizontal band of flexible material, a vertical top band interconnecting opposite sides of said horizontal band, a rigid arcuate shaped visor support secured to said horizontal band, and means for releasably securing said visor to said visor support.

24. A surgical masking and ventilating system for protecting an operating zone from contaminants emanated by members of a surgical team comprising protective apparel for substantially isolating each said member from the environment of the operating zone, said apparel for each member including a transparent visor, means for supporting said visor on the head of a member, said visor having an arcuate front portion and a flat flange about the periphery of said arcuate portion, a hood positioned over said visor and extending at least to shoulder length, a gown positioned over the shoulder portion of said hood and extending at least to knee level, said hood having a front aperture within which said visor arcuate portion is positioned, means for maintaining the periphery of said front aperture firmly against said visor, an aspirator, conduit means including a suction tube formed with a plurality of apertures extending in a loop about the mouth of the visor with the opposite ends of said suction tube being positioned at the back side of the user, means fluidically coupling said suction tube ends to said aspirator, snaps for releasably fastening the looped portion of said suction tube to a lower inside surface of said visor flange, said snaps each having one member secured to said tube and a second member fixed to said visor and said fastening members of each snap having a fastening surface which is releasably engageable, said aspirator having an enclosed housing with an inlet and an outlet, said coupling means fluidically coupling said suction tube ends to said housing inlet, a vacuum motor supported within said housing and having an inlet coupled to said housing inlet and an outlet communicating with the interior of said housing, said vacuum motor being operable to create a vacuum in said conduit means for drawing air and affluent contaminants within the apparel of each said member to said aspirator, a blower motor supported within said housing and having an inlet communicating with the interior of said housing and an outlet coupled to said housing outlet for directing said air and contaminants from said aspirator, said vacuum motor having a relatively high vacuum generating capacity and a relatively low air directing capacity and said blower motor having a relatively high air directing capacity and a relatively low vacuum generating capability, and means for filtering the air directed out of said aspirator outlet to a substantially contaminant free condition prior to its discharge into the environment of the operating zone.

* * * * *